US007293379B2

(12) United States Patent
Paulos

(10) Patent No.: US 7,293,379 B2
(45) Date of Patent: Nov. 13, 2007

(54) CALENDAR ORGANIZING SYSTEM

(76) Inventor: John Paulos, 3440 DuPont Ave. South, Apt. 103, Minneapolis, MN (US) 55408-4078

( * ) Notice: Subject to any disclaimer, the term of this patent is extended or adjusted under 35 U.S.C. 154(b) by 0 days.

(21) Appl. No.: 11/474,664

(22) Filed: Jun. 26, 2006

(65) Prior Publication Data

US 2007/0017130 A1 Jan. 25, 2007

Related U.S. Application Data

(60) Provisional application No. 60/697,623, filed on Jul. 8, 2005.

(51) Int. Cl.
*G09D 3/00* (2006.01)

(52) U.S. Cl. ..... 40/107; 40/122; 283/2; D19/20

(58) Field of Classification Search ..... 40/107, 40/121, 122; D19/20; 283/2
See application file for complete search history.

(56) References Cited

U.S. PATENT DOCUMENTS

| | | | | | |
|---|---|---|---|---|---|
| 237,825 | A | * | 2/1881 | Cussons | 281/43 |
| 811,846 | A | | 2/1906 | Hidden | |
| 1,879,260 | A | | 9/1932 | Howard | |
| 1,906,261 | A | * | 5/1933 | Glass | 40/121 |
| 2,831,278 | A | | 4/1958 | Myers | |
| 3,207,421 | A | | 9/1965 | Hunger et al. | |
| 3,605,306 | A | * | 9/1971 | Diambra | 40/107 |
| 3,911,606 | A | | 10/1975 | Hunkins | |
| 3,983,649 | A | | 10/1976 | Ellis et al. | |
| 4,058,916 | A | | 11/1977 | Whyatt | |
| 4,263,733 | A | * | 4/1981 | Cross | 40/121 |
| 4,803,795 | A | | 2/1989 | Questel et al. | |
| 4,850,124 | A | | 7/1989 | Wilen | |
| 4,858,350 | A | * | 8/1989 | Malarchik | 40/119 |
| 4,975,061 | A | | 12/1990 | Avrill | |
| 4,995,221 | A | | 2/1991 | Stemmer, Jr. | |
| 5,097,961 | A | | 3/1992 | Patino et al. | |
| 5,106,122 | A | * | 4/1992 | Perelman | 283/2 |
| 5,214,869 | A | | 6/1993 | Wilen | |
| 5,412,886 | A | | 5/1995 | Quinn | |
| 5,682,695 | A | * | 11/1997 | Hoffman | 40/594 |
| 5,797,204 | A | | 8/1998 | Paulos | |
| D411,570 | S | | 6/1999 | Hilliard, IV | |
| D456,453 | S | | 4/2002 | McCravy | |
| 6,591,522 | B2 | | 7/2003 | Doss | |

(Continued)

*Primary Examiner*—Gary C. Hoge
(74) *Attorney, Agent, or Firm*—Shewchuk IP Services; Jeffrey D. Shewchuk

(57) ABSTRACT

A 27"×28"×½" calendar/organizer that combines a large, 12-page, printed paper calendar with a ¼"-½" thick and "pin-receiving" backboard. The front sheets are printed with a calendar array of days and weeks, with each day having a height of at least four inches, such as days which are 4½ inches tall by 4 inches wide. The front sheets are attached to the backing board at their upper ends by two heavy duty staples, and have three mounting holes punched in aligned locations between the staples. The backing board is provided by double layer cardboard with each layer thicker than the plurality of front sheets, so the backing board can receive and hold a tack or push pin without regard to whether the tack or push pin extends through none, one or all of the front sheets. The backing board may extend longer than the front sheet calendar pages, so as to facilitate an additional "pinning surface" for items not associated with any particular day of the month.

20 Claims, 4 Drawing Sheets

U.S. PATENT DOCUMENTS 6,657,924 B2 12/2003 McCravy
6,694,650 B2 2/2004 Brown
D500,801 S 1/2005 Bowling, III
6,966,134 B2 11/2005 Ngan
7,033,180 B2 4/2006 Fujita

* cited by examiner

CALENDAR ORGANIZING SYSTEM

CROSS-REFERENCE TO RELATED APPLICATION(S)

This application claims priority benefits from Provisional Application No. 60/697,623, filed Jul. 8, 2005 and entitled PIN AND POST CALENDAR/ORGANIZER, incorporated herein by reference.

BACKGROUND OF THE INVENTION

The present invention pertains to organizers, and, more particularly, to calendar organizing systems for receiving and holding envelopes, cards, sticky notes and/or other documents associated with days on the calendar.

Calendar organizing systems have been known for some time. For instance, U.S. Pat. No. 811,846 to C. P. Hidden, U.S. Pat. No. 3,207,421 to H. R. Hunger et al., U.S. Pat. No. 3,911,606 to Hunkins, U.S. Pat. No. 4,975,061 to Avrill, U.S. Pat. No. 5,412,886 to Quinn, U.S. Pat. No. D411,570 to Hilliard, IV, U.S. Pat. No. 6,591,522 to Doss, and U.S. Pat. Nos. D456,453 and 6,657,924 to McCravy each disclose a calendar organizer with pockets for the days of the month. These calendar organizers generally have a large backing board with a front sheet attached thereto, with pockets formed between the front sheet and the back sheet. Indicia or markings are printed on the calendar organizer to identify dates associated with each of the pockets.

However, these previous calendar organizers have deficiencies which have prevented them from being widely used. In particular, the pockets on previous calendar organizers may have an opening size which limits the size of the items retainable in the pockets. Several concepts have been tried to enable the calendar organizers to receive larger items within the pockets. One such calendar organizer is disclosed in Applicant's U.S. Pat. No. 5,797,204, which include pockets open on two sides for holding items associated with each day. While the calendar organizing system of Applicant's U.S. Pat. No. 5,797,204 works very well for many people, it still has some drawbacks. The manufacture of this calendar organizing system, for versions having different sets of pockets for each month, is more expensive than some people desire to spend. For versions reusing the same sets of pockets for multiple months, the days of the week don't line up beginning with Sunday or the dates on the fronts of the pockets must be replaced or moved each month, which are additional difficulties that some users dislike. Alternative calendar organizer systems that can receive and hold large envelopes associated with days on the calendar, but which are still convenient to use and inexpensive to manufacture, are still needed.

BRIEF SUMMARY OF THE INVENTION

The present invention is a calendar organizer including a backing board and a plurality of front sheets. The front sheets are paper sheets printed with a calendar array of days and weeks, with each day preferably having a height of at least 4½ inches and a width of at least 4 inches. The front sheets are attached to the backing board at their upper ends. The backing board is thicker than the plurality of front sheets, so the backing board can receive and hold a tack or push pin without regard to whether the tack or push pin extends through none, one or all of the front sheets. In one aspect this backing board is provided by double layer cardboard, with each of the layers being thicker than the combined thickness of all the calendar sheets.

Figure 1:
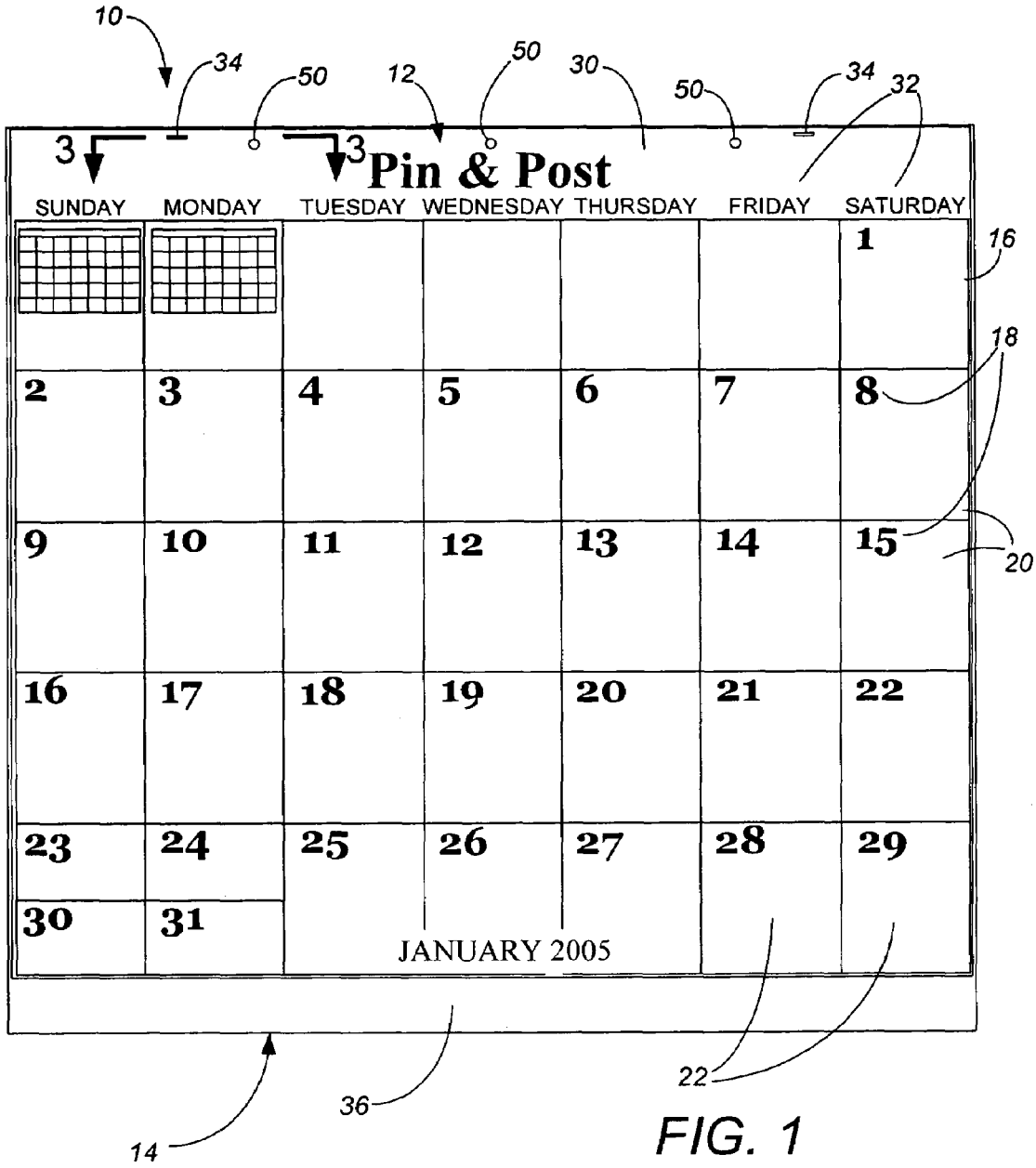
FIG. 1 is a front view of a calendar organizer in accordance with the present invention.

While the above-identified drawing figures set forth one or more preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

The calendar/organizer 10 of the present invention includes a number of front calendar sheets 12 and a backing board 14. The preferred calendar includes twelve front sheets 12, one for each month of a calendar year beginning in January. However, alternative versions can begin with a different month, such as a school year or fiscal year calendar, or last for a different period of time, such as a 16-month calendar. Calendar indicia are included in a traditional calendar array layout 16 as generally shown, including a number 18 designating the date of each day of the month. Each month array 16 includes at least five rows 20 of days 22, each row 20 having seven days 22 to thereby denote a week time period, so the whole array 16 can cover a month time period.

Figure 5:
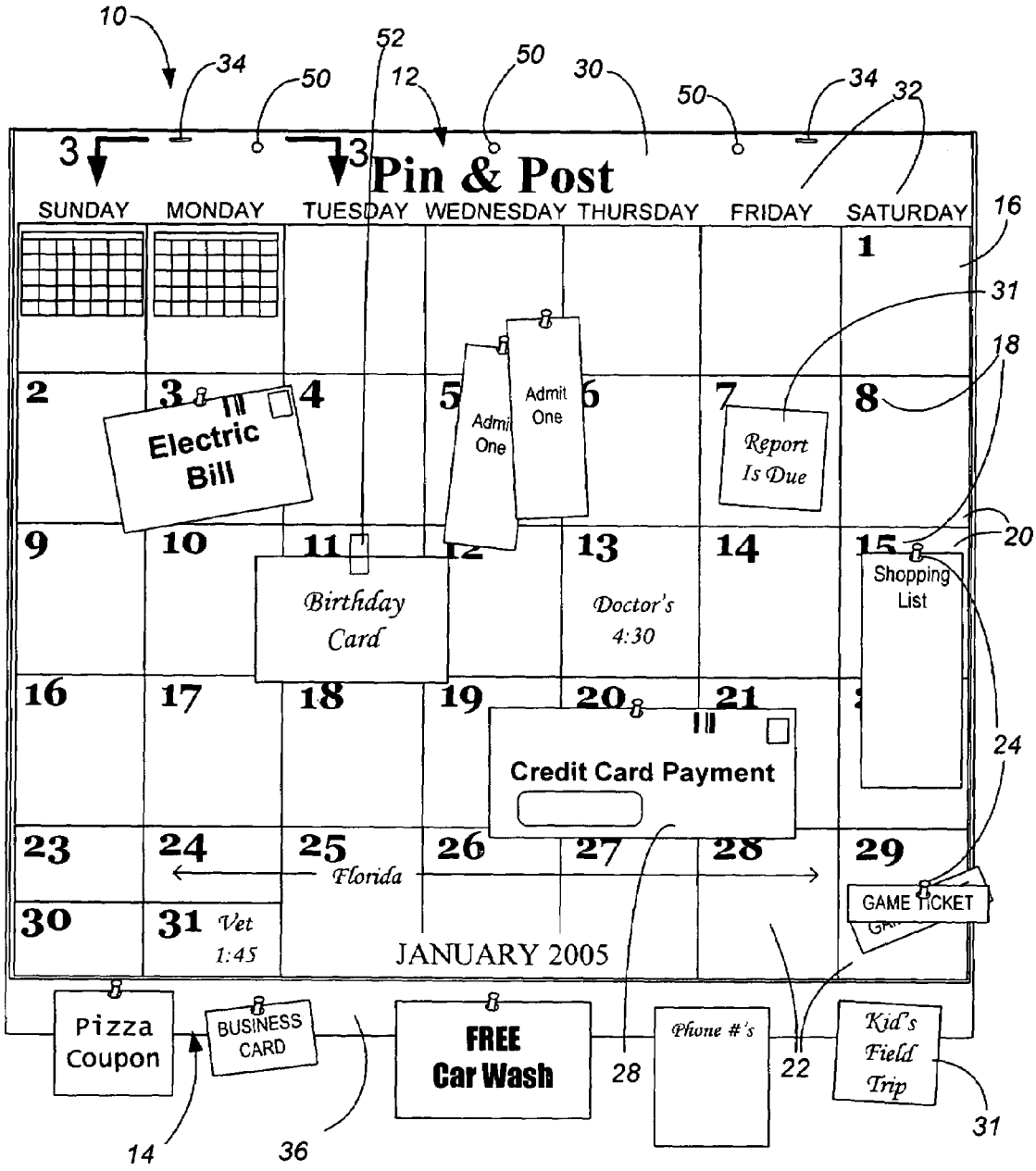
FIG. 5 is a front view of the calendar organizing system of FIGS. 1-3, shown populated with items associated with dates on the calendar.

While foil, film or cloth sheets could be used, the preferred front sheets 12 are formed of paper to minimize the thickness of the front sheets 12, maximum the ability of a push pin 24 or tack 26 to push through the front sheets 12, and minimize cost of the calendar organizer 10. With paper front sheets 12, the calendar indicia are printed on the front sheets 12 in ink. If desired, multi-color printing of one or more ornamental pictures or images (not shown) can be applied "behind", beside or together with the calendar indicia, but the simplest layout merely has the calendar indicia shown in FIG. 1. As shown in FIG. 5, paper can also be readily written on by the user and used as a traditional calendar is by handwriting events on the calendar.

An important feature of the calendar organizer 10 is the size of the days 22 on the front sheets 12. Each day 22 is at least four inches tall. For adequate arrangement into an array 16, so the days 22 do not appear too tall and skinny for users to readily understand the calendar array layout, the four inch height of each day 22 is matched with a width for each day 22 of three inches or more. This equates to the front sheets 12 being at least twenty inches tall (due to five weekly rows 20) and twenty-one inches wide (due to seven days 22 in each weekly row 20). A 3×4 inch size for day space 22 is also convenient to receive a sticky note 31 as desired on any selected day space 22, such as the most common size for POST-IT notes 31 of 2⅞×2⅞ inches. More preferably, each day 22 provides an area with four inches or more vertical clearance between adjacent date indicia 18. This specific size is important in that it allows the pinning and posting of standard 4 inch letters and bills (such as a standard 4"×9" envelope 28) on any specific date 22 without covering up any other numbered date 18, as shown in FIG. 5. The date indicia 18 on the preferred calendar array 16 are numbers approximately ½ inches tall, printed with a top margin in each day space 22 of about ¼$^{th}$ of an inch. The preferred calendar array 16 has each day 22 with a total vertical height of about 4½ inches, leaving each day space 22 with about 3¾ inches beneath the date indicium 18. With a 4½ inch height, a preferred width of each day 22 is about 4 inches. This 4×4½ inch size for day space 22 is ample to receive a sticky note 31 such as commonly sized POST-IT notes 31.

With five weekly rows 20 of days 22, this creates total dimensions of the calendar array 16 of 22½ inches tall by 28 inches wide. The preferred printing of front sheets 12 also include a top margin 30 of about 2½ inches, which includes spacing for printing the days 32 of the week beginning with "Sunday", as well as possibly other information such as advertising.

The monthly front sheets 12 should be attached at their top margin 30. By being attached at their top margin 30, users can temporarily move the front sheet 12 over and out of the way while writing on later months 12 on the calendar organizer 10. Once a month is completed, the top sheet 12 for that month can either be torn off and separately saved or discarded or folded over to behind the backing board 14. If desired, the individual calendar front sheets 12 may be perforated (not shown) along their top edges 30 for the purpose of enabling a controlled ripping and removal of spent pages 12 along that perforation.

In the preferred embodiment, the front sheets 12 are attached to each other with two and only two ½ inch long heavy duty staples 34, oriented horizontally. These two staples 34 are disposed fairly far apart on the front sheets 12, horizontally spaced by a distance of at least 12 inches. With two and only two horizontally oriented staples 34, the staples 34 define a natural location for folding over the top sheets 12 and allow tearing off of top sheets 12 without difficulty of having excessive attachment points. The preferred staple positions are about 3½ inches from the right and left edges of the front sheets 12, resulting in a spacing of about 21 inches between the two staples 34. Each staple 34 is about ⅓ inch below the top edge of both the front sheets 12 and the backing board 14. Alternative methods of attaching the front sheets 12 to the backing board 14 would include wire, glue, etc., but the use of two and only two heavy duty staples 34 is extremely cost effective and provides a surprisingly robust and functional connection for front sheets 12 of this size.

The backing board 14 is formed of a material which can be pierced by hand placement of a pin 24 to retain the pin 24 in position. The material of the backing board 14 is sufficiently rigid to avoiding bending or crumpling when supporting the weight of the plurality of front sheets 12 regardless of an angle of lean of the calendar organizer 10. The backing board 14 is at least coextensive with the front sheets 12, and therefore has a height of at least twenty inches, and more preferably at least 22½ inches. If desired, the backing board 14 may also provide an additional margin around the front sheets 12, and the preferred backing board 14 provides a bottom margin 36 of about 2½ inches, but no side or top margin, for total preferred dimensions of the backing board 14 of 27½ inches tall by 28 inches wide.

Figure 2:
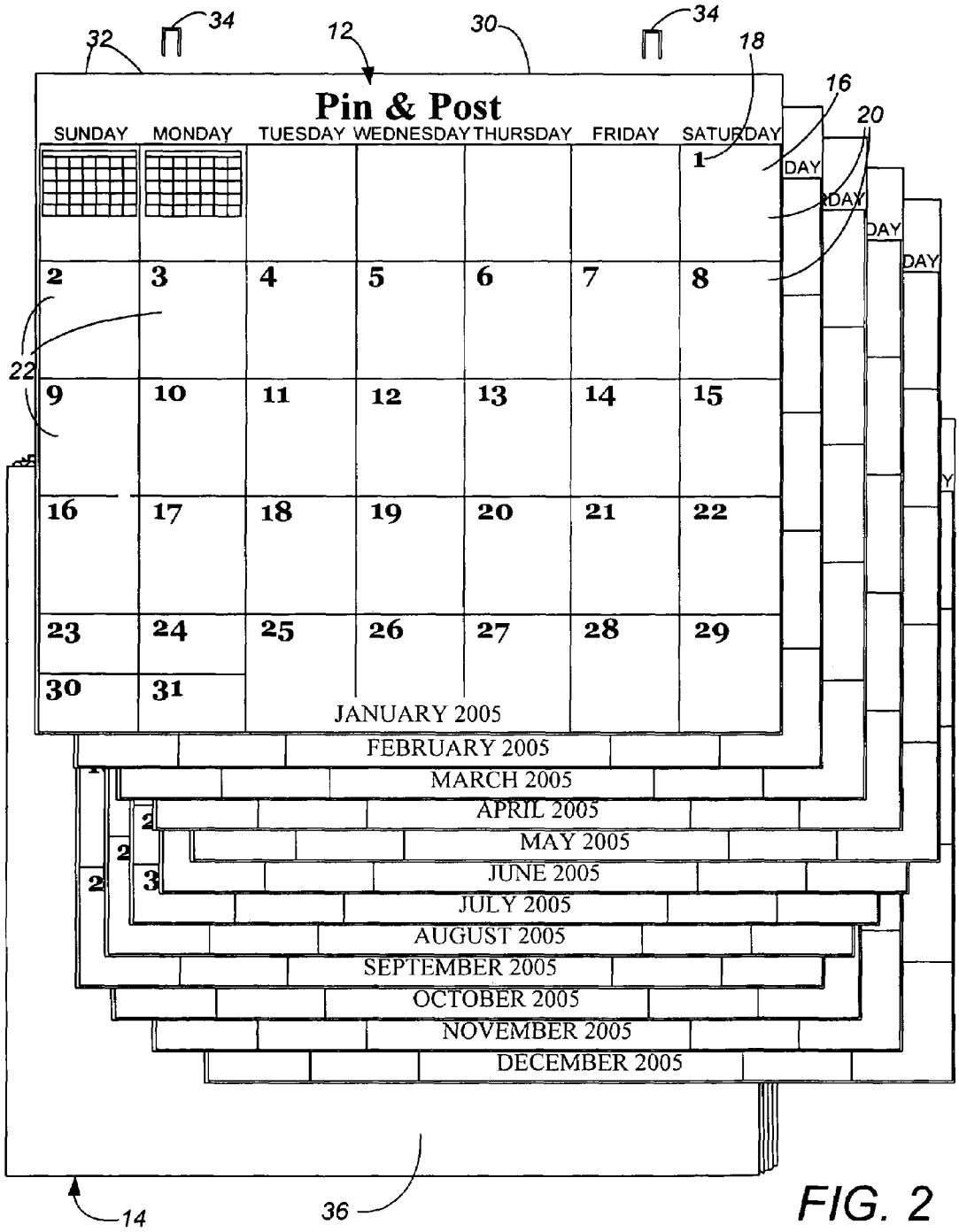
FIG. 2 is an exploded modified perspective assembly view of the calendar organizer of FIG. 1.
Figure 3:
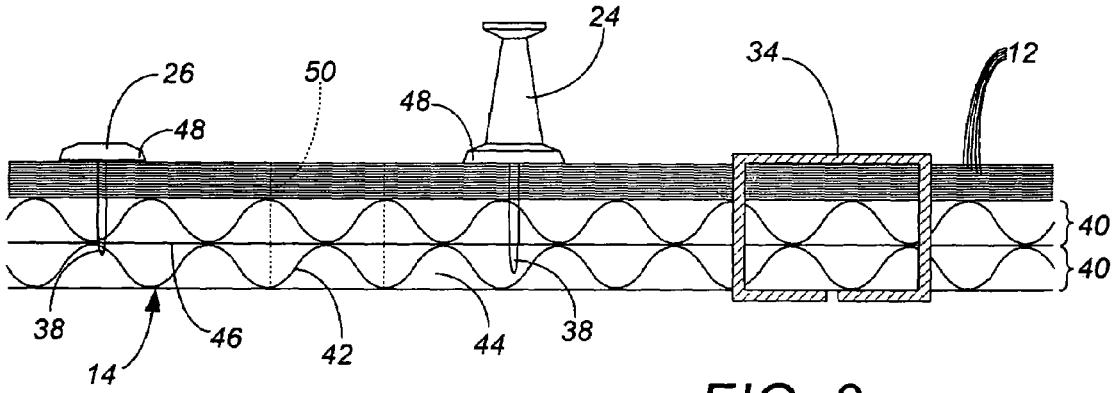
FIG. 3 is a cross-sectional view of the calendar organizing system of FIG. 1 taken along lines 3-3, and showing a tack and a push pin in the calendar organizer.

The backing board 14 is fairly thick, such as a thickness of at least ⅛ inch, and more preferably a thickness of ¼ to ½ inch. This thickness is needed for the backing board 14 to be able to receive pins 24 or tacks 26 and hold the pins 24 or tacks 26 in position without having the point 38 of the pin 24 or tack 26 extend significantly through the back side of the backing board 14. If desired, the backing board 14 could be formed of a standard bulletin board material, such as foam core, chipboard, corkboard, etc. However, in the preferred embodiment the backing board 14 is formed of double corrugated cardboard having a total thickness of ¼"-½", i.e., each layer 40 has a thickness of at least ⅛$^{th}$ inch. As best shown in FIGS. 2 and 3, the double corrugated cardboard has two sets of corrugations 42 defining planar corrugation spaces 44 with a mid-plane separator sheet 46. The corrugations 42 can run either vertically or horizontally.

Figure 4:
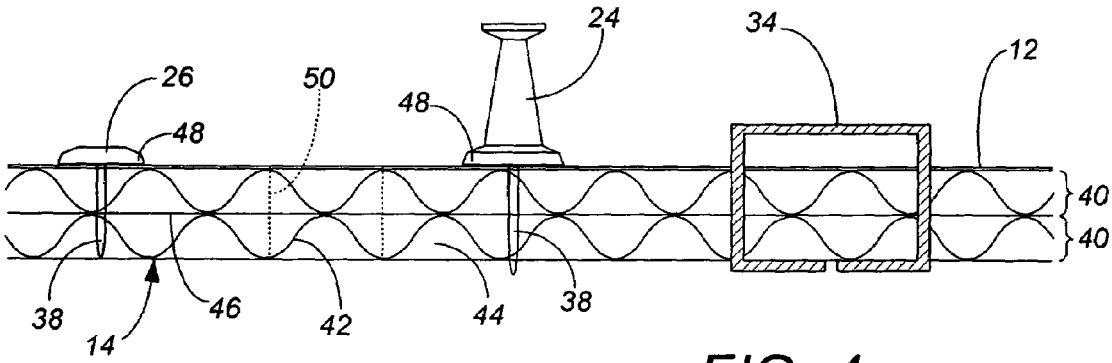
FIG. 4 is the cross-sectional view of FIG. 3, shown after removal of eleven monthly front sheets.

The two layers 40 of the double corrugated cardboard 14 thus each have a thickness which is at least the combined thickness of the twelve (or sixteen for a sixteen month calendar) front sheets 12. Because each layer 40 of cardboard 14 is at least as thick as the combined thickness of the front sheets 12, a pin 24 or tack 26 projecting through any number of front sheets 12 (from twelve down to one, as monthly sheets 12 are removed and as shown by comparing FIGS. 3 and 4) can be sized so the pin point 38 extends through the midplane sheet 46 but not through the back of the backing board 14. Because pins 24 or tacks 26 when used always extend through the midplane sheet 46, the midplane sheet 46 does a very good job of holding the pins 24 or tacks 26 in place regardless of the number of front sheets 12 being used. With the second layer 40 of corrugation 42, the pins 24 or tacks 26 do not extend significantly through the back of the backing board 14, even when the user is down to the last month of the calendar and the pins 24 or tacks 26 extend through only a single front sheet 12.

This ¼"-½" thick backing board 14 is four to eight times thicker than standard 1/16" uncorrugated cardboard. The preferred backing board 14 thus has a much better "pin-receiving quality" than existing calendars. With a backing board thickness of ¼ to ½ inch, the calendar organizer 10 can be used as shown in FIG. 5 with push pins, map pins, thumbtacks, etc. to be used to 'pin and post' items such as letters, bills, credit card payments, postcards, birthday cards, notes, memos, reminders, shopping lists, coupons, tickets, etc. onto and/or into the individual and specific dates on the front page of the calendar organizer's facade. The backing board 14 easily allows pins 24 to travel all the way through the paper calendar front sheet pages 12 and into the backing board 14 thereby securely fastening each item to a specific date on the calendar array 16 for which that item is intended to be used. Existing thinner calendars do not allow sufficient depth to easily and securely hold and fasten pins in place with a simple finger push of the pins.

The preferred embodiment is sold as a kit with a plurality of push pins 24 or tacks 26, each push pin 24 or tack 26 having a paper piercing metal tip 38 followed by a wider depth-setting shoulder 48. The wider depth-setting shoulder 48 limits the extent to which the push pin 24 or tack 26 can be inserted into the plurality of front sheets 12. The paper piercing metal tip 38 has a length which is about equal to or less than the thickness of the backing board 14, and in the preferred embodiment is about 5/16$^{th}$ inches. Even if the push pin 24 or tack 26 is used on the bottom margin 36 of the backing board 14 so the depth-setting shoulder 48 contacts the front face of the backing board 14, the tip 38 of the push pin 24 or tack 26 does not extend significantly through the back face of the backing board 14. The kit may also include releaseable tape 52 and/or sticky notes 31 such as appropriately sized POST-IT notes 31.

If desired, the calendar organizer 10 can be used in a leaning or lying position. The preferred calendar organizer 10 weighs approximately 3.6 pounds. The preferred double-corrugated backing board 14 is sufficiently rigid to avoiding bending or crumpling when supporting the weight of the plurality of front sheets 12, and does not crease or fold even while pinning through the middle of twelve front sheets 12, when the calendar organizer 10 is leaned at a 45° angle and otherwise unsupported in its middle. While being sufficiently strong to permit lying or leaning use, the preferred calendar organizer 10 includes at least one hanging hole 50 so the calendar organize can be hung.

The preferred embodiment includes three hanging holes 50: a single centered hanging hole 50 if the user wants to balance the calendar organizer 10 from a single nail or other support (not shown), and two more widely spaced, balanced hanging holes 50 allowing the user to use two nails or other supports (not shown) and thereby prevent the calendar organizer 10 from swaying or swinging on the wall. The preferred hanging holes 50 extend fully through all the front sheets 12 and the backing board 14 in an aligned manner. The preferred hanging holes 50 have a diameter of about ¼ inch, and can be readily formed through the paper front sheets 12 and the double corrugated backing board 14 by either punching or drilling therethrough. All three hanging holes 50 are preferably disposed between the two staples 34, such as at a height of about ¾ inches from the top edge and a spacing between hanging holes 50 of about seven inches. By being located between the two staples 34, if the hanging holes 50 catch on the head of a nail or other support (not shown), the staples 34 will prevent such catching from undesirably bending the caught front sheets 12.

Another feature of this calendar organizer 10 is that the backing board 14 may have a larger size than the front sheets 12 which are affixed to the backing board 14, provided in the preferred embodiment by the bottom margin 36. The top, bottom, and/or side edges of the backing board's facade may protrude or extend beyond the dimensions of the front sheets 12 for the purpose of allowing extra space for longer term items to be pinned, affixed or attached onto and/or into these protruding edges without being pinned onto and/or into the front sheets 12 themselves. The type of items that may be pinned, affixed or attached to these protruding areas of the backing board 14 are items that do not necessarily associate to any particular day 22 or items that may remain pinned, affixed or attached to the protruding edges of the backboard's facade without interfering with or being dependent upon the changing of the calendar's monthly pages (e.g. business cards, telephone numbers, coupons, stamps, menus, unfolded letters, receipts, etc.). Those wishing not to puncture the calendar organizer 10 or items may use tape, such as removeable tape 52. Other items, such as a pencil or pen, can be support upon two push pins 24 placed inches apart. The bottom margin 36 is also useful for storing push pins 24 and tacks 26 when not holding items, particularly at the end of a month when the user is proceeding to the next month's front sheet 12.

The calendar organizer 10 of the present invention is great for mailing letters and paying bills on time. The calendar organizer 10 can be used for organizing coupons, receipts, shopping lists, homework, banking items, lottery tickets, sticky notes such as POST-IT notes, etc., and is great for organizing and providing reminders for sports tickets, concert tickets, birthday cards etc.

Although the present invention has been described with reference to preferred embodiments, workers skilled in the art will recognize that changes may be made in form and detail without departing from the spirit and scope of the invention.

The invention claimed is:

1. A calendar organizer comprising:

a backing board of a material which can be pierced by hand placement of a pin to retain the pin in position, the backing board having a thickness of at least ¼ inch, the backing board having a height of at least 20 inches, the backing board being formed of double thickness corrugated cardboard having two sets of corrugations defining planar corrugation spaces with a mid-plane separator sheet;

a plurality of front sheets, each front sheet being formed of paper, each front sheet bearing calendar indicia covering a month time period including an array of at least five rows of days, each row having seven days to thereby denote a week time period, each row having a height of at least 4 inches; and at least one hanging hole extending fully through the plurality front sheets and the backing board;

wherein each of the plurality of front sheets are attached to the backing board at upper ends of the plurality of front sheets, and wherein each thickness of the cardboard is at least the combined thickness of the plurality of front sheets.

2. The calendar organizer of claim 1, wherein the backing board is formed of double thickness corrugated cardboard having two sets of corrugations defining planar corrugation spaces with a mid-plane separator sheet, with each thickness of the cardboard being at least the combined thickness of the plurality of front sheets.

3. The calendar organizer of claim 2, wherein the plurality of front sheets are attached to the backing board by a plurality of staples at the upper ends of the plurality of front sheets.

4. The calendar organizer of claim 3, wherein the plurality of staples consists of two staples horizontally spaced by a distance of at least 12 inches.

5. The calendar organizer of claim 3, wherein the backing board is formed of double thickness corrugated cardboard having two sets of corrugations defining planar corrugation spaces with a mid-plane separator sheet, with each thickness of the cardboard being at least the combined thickness of the plurality of front sheets.

6. The calendar organizer of claim 1, wherein the backing board is sufficiently rigid to avoiding bending or crumpling when supporting the weight of the plurality of front sheets regardless of an angle of lean of the calendar organizer.

7. The calendar organizer of claim 6, wherein each day in the calendar indicia has a number denoting the date of the month associated with that space on the front sheet, with a row spacing having a height of at least 4 inches between numbers on adjacent rows of days, and each day further having a width of at least 3 inches such that each row denotes a week of days extending over a width of at least 21 inches.

8. The calendar organizer of claim 7, wherein each day has a width of at least 4 inches such that each row denotes a week of days extending over a width of at least 28 inches.

9. The calendar organizer of claim 1, wherein the backing board has a height of at least 25 inches, wherein each row has a height of at least 4½ inches, and wherein each day has a width of at least 4 inches such that each row denotes a week of days extending over a width of at least 28 inches.

10. The calendar organizer of claim 1, wherein the backing board comprises a bottom margin which extends longer than the front sheets to provide an additional pinning surface items not associated with any particular day of the month time period.

11. A calendar organizer comprising:

a backing board of a material which can be pierced by hand placement of a pin to retain the pin in position, the backing board having a thickness of at least ⅛ inch, the backing board having a height of at least 20 inches; and a plurality of front sheets, each front sheet being formed of paper, each front sheet bearing calendar indicia covering a month time period including an away of at least five rows of days, each row having seven days to thereby denote a week time period, each row having a height of at least 4 inches, wherein each of the plurality of front sheets are attached to the backing board at upper ends of the plurality of front sheets, wherein the plurality of front sheets are attached to the backing board by two and only two staples at the upper ends of the plurality of front sheets, the two staples being horizontally spaced by a distance of at least 12 inches, a further comprising a plurality of hanging holes extending fully through the plurality of front sheets and the backing board, with all of the plurality of hanging holes being disposed between the two staples.

12. A calendar organizer comprising:

a backing board of a material which can be pierced by hand placement of a pin to retain the pin in position, the backing board having a thickness of at least ⅛ inch, the backing board having a height of at least 20 inches;

a plurality of front sheets, each front sheet being formed of paper, each front sheet bearing calendar indicia covering a month time period including an away of at least five rows of days, each row having seven days to thereby denote a week time period, each row having a height of at least 4 inches, wherein each of the plurality of the front sheets are attached to the backing board at upper ends of the plurality of front sheets; and a plurality of push pins or tacks, each push pin or tack having a paper piercing metal tip followed by a wider depth-setting shoulder which limits the extent to which the push pin or tack can be inserted into the plurality of front sheets, with the paper piercing metal tip having a length which is about equal to or greater than half the thickness of the backing board and about equal to or less than the thickness of the backing board.

13. The calendar organizer of claim 2, wherein the backing board has a thickness of at least ¼ inch.

14. A calendar organizer comprising:

a backing board formed of double thickness corrugated cardboard having two sets of corrugations defining planar corrugation spaces with a mid-plane separator sheet, the backing board having a height of at least 20 inches and a width of at least 21 inches; and a plurality of front sheets, each front sheet being formed of paper, each front sheet bearing calendar indicia covering a month time period including an away of at least five rows of days, each row having seven days to thereby denote a week time period, wherein each day in the calendar indicia has a number denoting the date of the month associated with that space on the front sheet, with a row spacing having a height of at least 4 inches between numbers on adjacent rows of days, and each day further having a width of at least 3 inches such that each row denotes a week of days extending over a width of at least 21 inches;

with a combined thickness of the plurality of front sheets being no greater than a thickness of corrugations of each layer of the double thickness corrugated cardboard, wherein each of the plurality of front sheets are attached to the backing board at upper ends of the plurality of front sheets; and a plurality of push pins or tacks, each push pin or tack having a paper piercing metal tip followed by a wider depth-setting shoulder which limits the extent to which the push pin or tack can be inserted into the plurality of front sheets, with the paper piercing metal tip having a length which is about equal to or less than the thickness of the backing board;

wherein the backing board is sufficiently rigid to avoiding bending or crumpling when supporting the weight of the plurality of front sheets and the plurality of push pins or tacks regardless of an angle of lean of the calendar organizer.

15. The calendar organizer of claim 14, wherein the backing board has a thickness of at least ¼ inch.

16. The calendar organizer of claim 14, wherein the plurality of front sheets are attached to the backing board by a plurality of staples at the upper ends of the plurality of front sheets.

17. The calendar organizer of claim 16, wherein the plurality of staples consists of two staples horizontally spaced by a distance of at least 12 inches.

18. The calendar organizer of claim 14, further comprising at least one hanging hole extending fully through the plurality front sheets and the backing board.

19. The calendar organizer of claim 14, wherein the plurality of front sheets are attached to the backing board by two and only two staples at the upper ends of the plurality of front sheets, the two staples being horizontally spaced by a distance of at least 12 inches, a further comprising a plurality of hanging holes extending fully through the plurality of front sheets and the backing board, with all of the plurality of hanging holes being disposed between the two staples.

20. The calendar organizer of claim 14, wherein the backing board has a height of at least 25 inches, wherein each row has a height of at least 4½ inches, and wherein each day has a width of at least 4 inches such that each row denotes a week of days extending over a width of at least 28 inches, and wherein the backing board comprises a bottom margin which extends longer than the front sheets to provide an additional pinning surface for items not associated with any particular day of the month time period.

* * * * *

UNITED STATES PATENT AND TRADEMARK OFFICE

CERTIFICATE OF CORRECTION

PATENT NO. : 7,293,379 B2
APPLICATION NO. : 11/474664
DATED : November 13, 2007
INVENTOR(S) : John Paulos It is certified that error appears in the above-identified patent and that said Letters Patent is hereby corrected as shown below:

At column 6, lines 44-49, claim 5 is corrected as follows:
5. The calendar organizer of claim ~~3, wherein the backing board is formed of double thickness corrugated cardboard having two sets of corrugations defining planar corrugation spaces with a mid plane separator sheet, with each thickness of the cardboard being at least the combined thickness of the plurality of front sheets~~ 2, further comprising at least one hanging hole extending fully through the plurality of front sheets and the backing board.

At column 7, line 5, claim 10 is corrected as follows:
After "pinning surface", insert --for--.

At column 7, line 15, claim 11 is corrected as follows:
Delete "away", and insert therefore --array--.

At column 7, line 37, claim 12 is corrected as follows:
Delete "away", and insert therefore --array--.

At column 7, line 51, claim 13 is corrected as follows:
Delete "claim 2", and insert therefore --claim 12--.

At column 8, line 1, claim 14 is corrected as follows:
Delete "away", and insert therefore --array--.

Signed and Sealed this

Twentieth Day of May, 2008

JON W. DUDAS
*Director of the United States Patent and Trademark Office*